United States Patent [19]

Spühler

[11] 4,107,908

[45] Aug. 22, 1978

[54] METHOD AND APPARATUS FOR MANUFACTURING A SPUN YARN FROM ONE OR SEVERAL FILAMENTS

[75] Inventor: Heinrich Spühler, Oberägeri, Switzerland

[73] Assignee: Aktiengesellschaft Fr.Mettler's Söhne, Maschinenfabrik, Switzerland

[21] Appl. No.: 804,245

[22] Filed: Jun. 7, 1977

[30] Foreign Application Priority Data

Jun. 15, 1976 [CH] Switzerland ..... 7633/76

[51] Int. Cl.[2] ..... D02J 1/00; D01H 7/00; D01H 7/46; D02G 3/34

[52] U.S. Cl. ..... 57/1 R; 57/34 R; 28/247

[58] Field of Search ..... 57/1 R, 29, 34 R, 156, 57/157 R, 138; 28/247, 252, 258

[56] References Cited

U.S. PATENT DOCUMENTS

| | | | |
|---|---|---|---|
| 2,719,350 | 10/1955 | Slayter et al. | 28/247 X |
| 2,719,352 | 10/1955 | Slayter et al. | 28/247 X |
| 2,886,877 | 5/1959 | Frickert et al. | 57/140 G X |
| 3,060,674 | 10/1962 | Slayter | 56/140 R |
| 3,145,523 | 8/1964 | Burbank | 57/1 R |
| 3,325,873 | 6/1967 | Shattuck | 28/252 |
| 3,409,195 | 11/1968 | Benson | 57/140 G UX |
| 3,446,001 | 5/1969 | Akachi | 57/138 |
| 3,492,803 | 2/1970 | Cannon et al. | 57/138 X |

*Primary Examiner*—Donald Watkins
*Attorney, Agent, or Firm*—McGlew and Tuttle

[57] ABSTRACT

A method of manufacturing spun yarn comprises feeding at least one filament onto a rotating member in a manner to form flat loops of the filaments on the member, picking the loops off the member and feeding and twisting the loops to form a spun yarn. The device advantageously includes a spinning head which rotates about a longitudinal axis and which carries a disc member which rotates about its own central axis. A thread guiding device is arranged to rotate about the longitudinal axis of the spinning head and separate drives are provided for each of the spinning head, the disc and the thread guide in order to form variations in the flat loops which are formed as segmental partly overlapped loops on the disc member. The construction includes a pickup member for picking up the loops off the disc and conveying rollers for conveying the twisted yarn into a setting chamber and a force twisting device for subsequent winding on a bobbin.

10 Claims, 4 Drawing Figures

METHOD AND APPARATUS FOR MANUFACTURING A SPUN YARN FROM ONE OR SEVERAL FILAMENTS

BACKGROUND OF THE INVENTION

1. Field of the Invention

The present invention relates in general to yarn forming methods and apparatus and in particular to a new and useful method of manufacturing a spun yarn from one or several filaments which are fed in from one or several spinnerets or thread bobbins, as well as to a device for carrying out the method.

2. Description of the Prior Art

The starting materials for the method are, in particular, continuous man-made fibers which, for example, are extruded in viscous form from spinning nozzles in a wet or dry spinning process, and subsequently consolidated.

Up to the present time, these man-made filaments have been further processed to spun yarns in a manner such that they were cut to desired lengths, then compressed, and delivered in the form of bales to spinning mills.

In the spinning mill, the processing of these synthetic filaments is identical with that of natural fibers. Substantially, the following operations are involved: loosening-up the compressed fiber material in bale openers, unravelling the fiber flocks with the aid of flat or roller cards, combing the card sliver on the combing machine, forming the roving, for example, on a flyer spinning frame, and, finally, fine-spinning the roving, for example, on a ring spinning frame where the finished yarn is wound on a bobbin. These operations require an ample machine outfit.

SUMMARY OF THE INVENTION

The present invention is directed to a method of the above-mentioned kind and to a device for carrying out the method, making it possible to produce from one or several continuous filaments directly a spun yarn, without using the ample machinery enumerated in the foregoing and belonging to the prior art.

In accordance with the invention, the method comprises the operational steps of forming the filament or filaments to substantially flat loops which partly overlap one another, and twisting these loops together into a spun yarn. The obtained result is that the spun yarn gets an appearance and nature similar to threads which are manufactured, in the conventional way, from cut staple fibers. During the further processing, however, no fiber fly occurs.

If desired for influencing the appearance and nature of the spun yarn, a variant of the method provides that prior to the twisting operation, at least a part of the loops may be cut open in the deflection areas of the filament or filaments.

The device for carrying out the inventive method comprises a spinning head mounted for rotation about its own longitudinal axis, a staple disc which is carried by the spinning head and mounted for rotation about an axis perpendicular to the longitudinal axis of the head and onto which the filament or filaments fed from a thread guide arm are segmentally wound up to form flat loops partly overlapping one another, a pickup member mounted adjacent the staple disc at the opposite side thereof relative to the thread guide arm and intended for removing the loops twisted into a spun yarn, and, following the pickup member, a mechanism for conveying and stretching the spun yarn.

Thus, the flat, partly overlapping, loops are formed on the staple disc which rotates both about its own axis and about the longitudinal axis of the spinning head, and the twisting of the loops is automatically obtained by this latter rotation of the spinning head.

Advantageously, the thread guide arm is mounted for rotation at an adjustable speed and about an axis which is at least approximately aligned with the longitudinal axis of the rotary spinning head. Due to this design, it is obtained that the speed at which the filament or filaments are wound up on the staple disk is independent of the rotational speed of the spinning head.

Preferably, the thread guide arm is mounted also for displacement along the longitudinal axis of the rotary spinning head. This makes it possible to vary the length of the loops formed on the staple disc.

In order to hold the loops fast on the surface of the staple disc, the circumference of the disc is preferably toothed or roughened.

It is purposeful to provide the staple disc with a circumferential groove. Then, the pickup member can engage into this groove, whereby the removal of the loop is facilitated.

The device may also be provided with a knife which can be swung into the groove in the area of the pickup member. This permits cutting at least a part of the loops.

Accordingly it is an object of the invention to provide a method of manufacturing spun yarn which comprises feeding at least one filament in a manner to form flat loops of the filaments and twisting the loops together to form a spun yarn.

A further object of the invention is to provide a device for forming spun yarn which includes means for guiding one or more filaments over a segmental portion of a rotatable disc which is supported on a rotatable spinning head or being rotatable to form a flat segmental overlapping loop including means for picking the loops off the discs and for feeding and twisting the loops.

A further object of the invention is to provide a device for manufacturing spun yarn which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

GENERAL DESCRIPTION OF THE PREFERRED EMBODIMENTS

Figure 1:
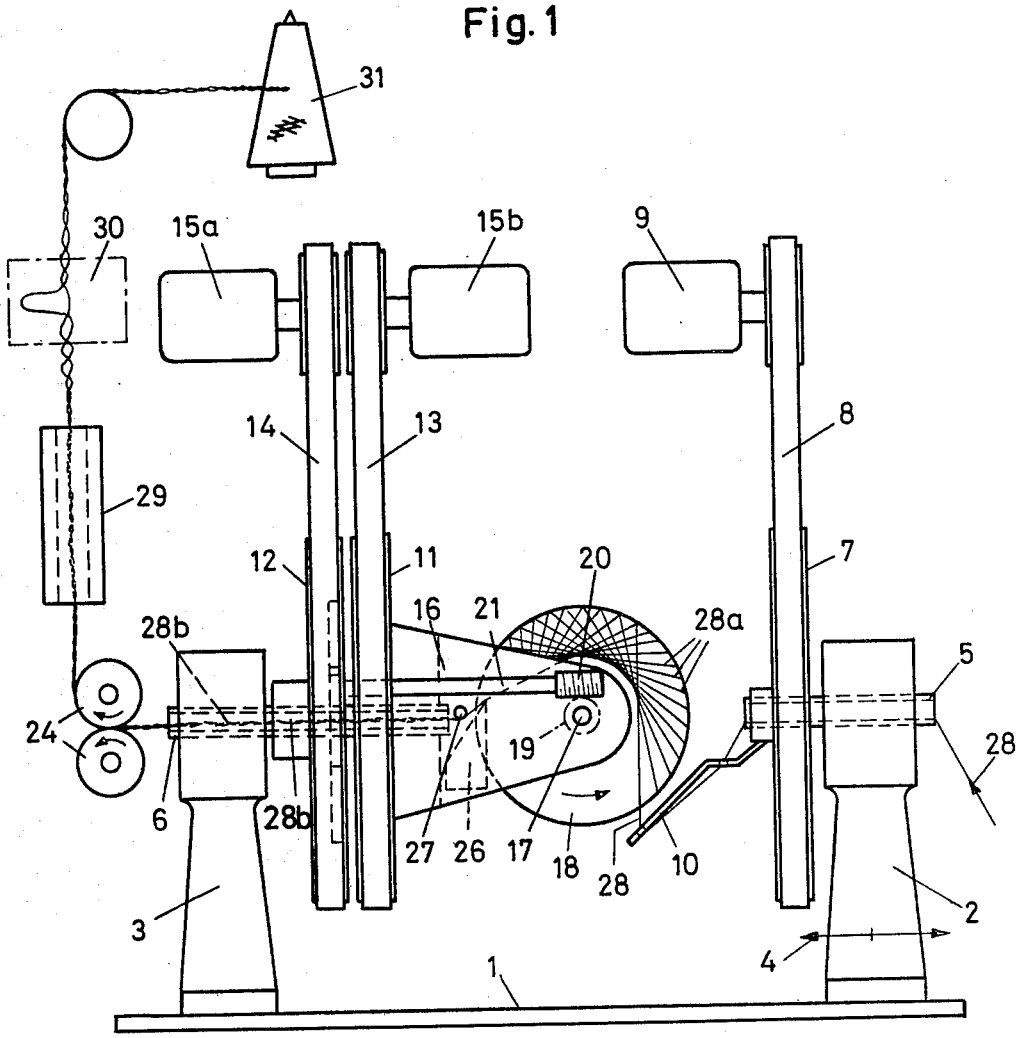
FIG. 1 is a side elevational view of a device for manufacturing spun yarn from one or more filaments constructed in accordance with the invention.
Figure 2:
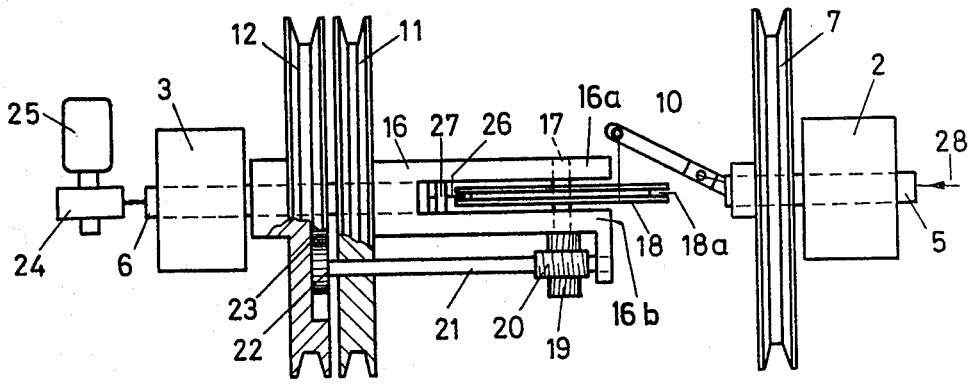
FIG. 2 is a top plan view of the device shown in FIG. 1.

Referring to the drawings in particular, the invention embodied therein in FIGS. 1 and 2 comprises a device for manufacturing spun yarn from one or more filaments 28 which are fed by a thread guiding arm 10 over a rotatable disc 18 which is mounted for rotation about a central axis of a shaft 17 which is journalled on a spinning head which itself is rotatable about a longitudinal axis which intercepts the central axis.

The device shown in FIGS. 1 and 2 is supported on a base plate 1 and two end bearing brackets or pedestals 2 and 3. Bracket 3 is rigidly connected to base plate 1, while bracket 2 is movable toward and away from bracket 3, as indicated by the double arrow 4, and fixable in any position. Brackets 2 and 3 support guide tubes 5 and 6 respectively by which the respective axes of rotation are embodied. Guide tube 5 carries a pulley 7 mounted thereon and driven, through a belt 8, by a motor 9 the speed of which is adjustable. A thread guide arm 10 is secured to pulley 7.

On guide tube 6 of bearing bracket 3, two pulleys 11 and 12 are mounted for rotation. Pulley 11 is driven, through a belt 13, by an adjustable speed motor **15*b*. In the same manner, pulley 12 is driven, through a belt 14, by an adjustable speed motor 15*a***.

The spinning head 16 is rigidly secured to pulley 11. The head comprises two arms **16*a* and 16*b* between which a staple disc 18 is carried on a rotatable shaft 17. Shaft 17 is mounted for rotation in spinning head 16 and carries a worm wheel 19 meshing with a worm 20. Worm 20 is carried on the end of a shaft 21 which is provided, on its other end, with a pinion 22. Pinion 22 meshes with a gear 23 which is firmly secured to pulley 12**.

Externally of bearing bracket 3, a pair of rollers 24, 24 is provided which is driven, at adjustable speed, by a motor 25. On its circumferential face, staple disk 18 is provided with a groove **18*a*. Yarn pickup and conveying means include the rollers 24, 24 and a pickup member 26 and a deflection member 27 for the spun yarn which are also mounted in spinning head 16. Pickup member 26 is mounted for engaging in groove 18*a* of staple disk 18**.

The device operates as follows.

If pulleys 11 and 12 are driven at equal speeds, only spinning head 16 rotates about guide tube 6. If pulleys 11 and 12 rotate at unequal speeds, shaft 17 and, thereby, staple disc 18 are driven through shaft 21. Consequently, the speeds of spinning head 16 and of staple disc 18 can be varied in any manner.

If now a filament 28 is fed from a spinning nozzle or a bobbin, through guide tube 5, to thread guide arm 10, and provided staple disk 18 rotates in the direction indicated by the arrow, the filament can be wound or stapled segmentally, in flat loops **28*a* along chordal lines, on disc 18. Loops 28*a* are removed from staple disc 18 by pickup member 26. Since spinning head 16 rotates relatively rapidly, loops 28*a* are automatically twisted into a spun yarn 28*b* which is conveyed, around deflecting member 27, into guide tube 6, and then gripped by the pair of rollers 24 serving as conveying and stretching rollers, for being further advanced. Thereafter, in a manner known per se, the yarn may be set against twisting, in a setting chamber 29. Also, the spinning twist of the yarn may be substantially amplified in set chamber 29 by back drafting with the aid of a conventional false twisting device 30, prior to winding the yarn to a cheese or cross-wound bobbin 31, by means of a cone winder. The parts 29, 30 and 31** are well known and do not belong to the subject matter of the invention.

Figure 3:
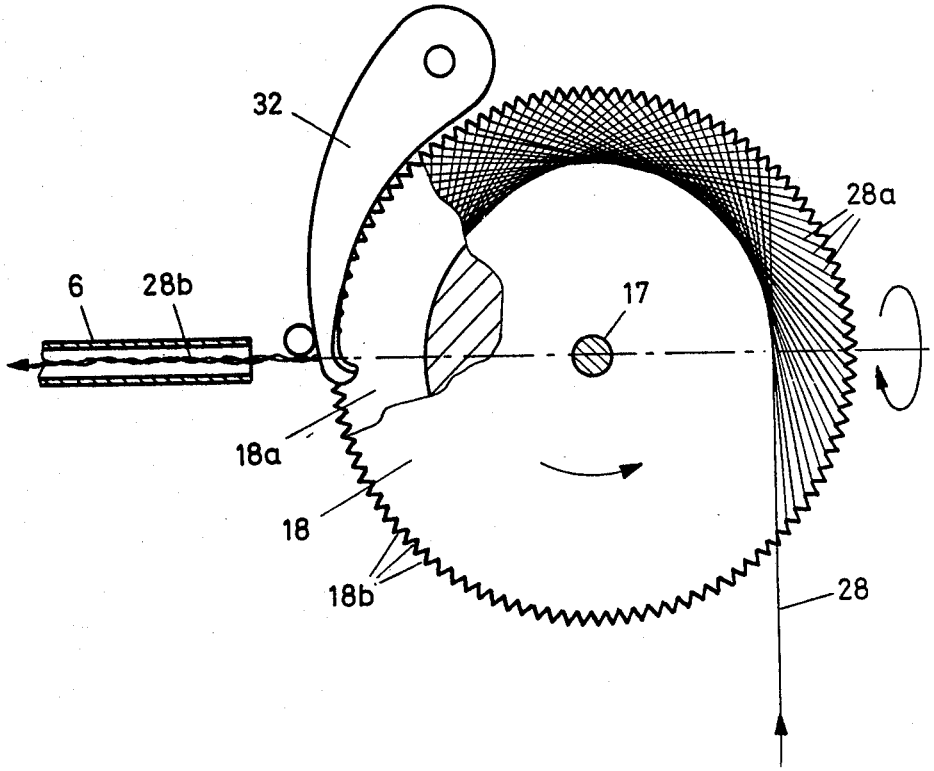
FIG. 3 is an enlarged side elevational view of the staple disc of another embodiment of the invention including a knife for cutting the loops.

FIG. 3 shows, on a larger scale, a staple disc 18 with loops **28*a* wound thereon. To make the loops adhere to the circumferential face of the disc, the circumference may be provided with teeth 18*b* or indentations. Instead of a toothing, the circumferential face might also be roughened, in order to increase the adhesion of the loops. In addition, a pivotable knife 32 may be provided on spinning head 16, which can be swung into groove 18*a*** to cut the loops open, whereby the structural nature of the spun yarn is changed.

Figure 4:
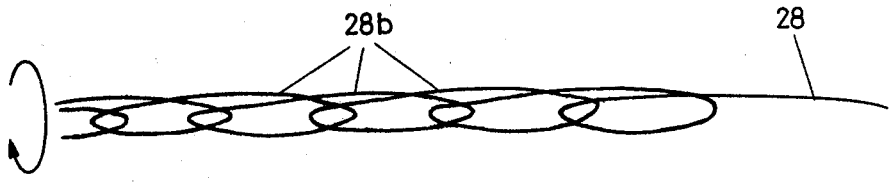
FIG. 4 is a view of the filaments as formed to partly overlapping loops prior to twisting.

FIG. 4 illustrates how the filament 28 is wound or stapled, in accordance with the inventive method, to flat, partly overlapping loops **28*a*** which are then twisted.

Thread guide arm 10 must be able to perform a rotary motion, since a relatively high rotational speed of spinning head 16 is necessary for twisting the spun yarn. On stable disk 18, however, loops **28*a* must be wound up at a relatively low speed. Therefore, pulley 7 is driven at a slightly lower speed than pulley 11. Then, only the differential speed between pulleys 11 and 7 is determinative for the winding of loops 28*a***.

By varying the differential speed between staple disc 18, spinning head 16, and thread guide arm 10, the structural nature and appearance of spun yarn **28*b*** can be largely influenced.

In the drawings, a single filament 28 is shown. It is possible, of course, to feed simultaneously a plurality of filaments, even of different material, to staple disc 18, whereby a great variety of yarns may be manufactured.

As mentioned, the showing of FIGS. 1 and 2 of the embodiment of the device is purely diagrammatical. In practice, the drives of spinning head 16, staple disc 18 and thread guide arm 10 may be designed differently.

The device includes drive means in the form of motors **15*a* and 15*b* and motor 9** for effecting the timed rotation of the spinning head, the disc and the thread guide arm in order to produce the twisted yarn of the invention.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

What is claimed is:

1. A device for manufacturing spun yarn, comprising a rotatable disc rotatable about its own central axis, and a spinning head on which said disc is mounted for rotation being rotatable itself about a longitudinal axis at right angles to the axis of said disc, a filament guide member mointed for rotation about the axis of said spinning head and guiding filament onto said disc during rotation of said disc and said spinning head so as to form segmental partly overlapped flat loops on said disc, drive means connected to said spinning head and said disc and said filament guide member to rotate said spinning head and said disc and said guide member at selected speeds, and pickup and conveying means adjacent said disc opposite to said filament guide member for picking up the twisted yarn from said disc and conveying it away from said spinning head as it is twisted by rotation of said spinning head.

2. A device according to claim 1, including means for cutting at least some of the loops which are formed.

3. A device according to claim 1, wherein said thread guide arm is rotatable at an adjustable speed about an axis which is at least approximately aligned with the longitudinal axis of said spinning head, said drive means including a separate drive connected to said spinning head and a separate drive connected to said thread guide arm.

4. A device according to claim 3, including means mounting said thread guide arm for displacement along the axis of said spinning head.

5. A device according to claim 1, wherein said drive means includes a separate drive for said disc, and a separate drive for said spinning head.

6. A device according to claim 1, wherein said spinning disc has a roughened surface for easy engagement with the filaments.

7. A device according to claim 1, wherein said disc is provided with a circumferential droove.

8. A device according to claim 1, including a knife mounted adjacent said disc which is pivotable so that it would swing against said disc to sever a thread on the surface thereof.

9. A device according to claim 1, including a first guide tube rotatably mounted about the axis of rotation of said thread guide arm and having a connection therethrough for the filament which extends to said guide arm, a second guide tube extending through said spinning head having a bore therethrough for the passage of a twisted yarn.

10. A method of manufacturing spun yarn comprising feeding at least one filament onto a rotating member in a manner for form flat loops of the filaments while the rotating member is supported on a spinning head which is rotated at a speed relative to the rotating member and the thread is guided onto the rotating member by moving it in a rotational path over an end thereof to deposit the thread in segmental areas in flat loops, adjusting the speeds of rotation of the disc, rotation of the spinning head and rotation of the thread guide arm so that they are selectively varied in order to vary the formation of the loops and the type of thread which is formed, picking the loops of the rotating member and twisting the loops to form the spun yarn.

* * * * *